United States Patent [19]

Maekawa et al.

[11] 4,447,487

[45] May 8, 1984

[54] HEAT-SENSITIVE RECORDING PAPERS

[75] Inventors: Masakazu Maekawa; Hiroharu Matsukawa, both of Shizuoka, Japan

[73] Assignee: Fuji Photo Film Company, Limited, Kanagawa, Japan

[21] Appl. No.: 436,081

[22] Filed: Oct. 22, 1982

[30] Foreign Application Priority Data

Oct. 22, 1981 [JP] Japan ..... 56-169034

[51] Int. Cl.[3] ..... B41M 5/18

[52] U.S. Cl. ..... 346/200; 428/311.1; 428/537.5; 428/913

[58] Field of Search ..... 282/27.5; 427/150–153; 428/211, 320.8, 409, 411, 488, 537, 913, 914, 199, 311.7, 341, 342

[56] References Cited

U.S. PATENT DOCUMENTS 4,032,690 6/1977 Kohmura et al. ..... 428/537

4,098,114 7/1978 Asao et al. ..... 428/914

*Primary Examiner*—Bruce H. Hess

*Attorney, Agent, or Firm*—Sughrue, Mion, Zinn, Macpeak and Seas

[57] ABSTRACT

A heat-sensitive recording paper is disclosed. The paper is comprised of a support base which is made of a paper having a density 0.9 g/cm$^3$ or less and a heat-sensitive recording layer coated on the support base. The surface of the heat-sensitive recording layer has an optical contact ratio of 7% or more. By utilizing the particularly disclosed support base paper and adjusting the optical contact ratio of the surface of the heat-sensitive recording layer, the resulting recording paper can give high heat conductivity between the surface of the recording layer and a recording element. Accordingly, the recording paper has a fast response speed and can produce a high density image without disadvantages such as increased fog formation.

8 Claims, No Drawings

HEAT-SENSITIVE RECORDING PAPERS

FIELD OF THE INVENTION

This invention relates to a heat-sensitive recording paper which can create an image in combination with a recording device such as a thermal head or a thermal pen. More particularly, it relates to a heat-sensitive recording sheet capable of providing a clear high-density image during high speed recording without sticking between the heat-sensitive color forming layer and the thermal head or piling of the fused material of the heat-sensitive color forming layer on the thermal head.

BACKGROUND OF THE INVENTION

A heat-sensitive recording paper is a recording paper which forms images by utilizing the physical and chemical changes of a material or materials induced by the action of heat energy. Various processes involving heat-sensitive recording papers have been investigated.

Various heat-sensitive recording papers utilizing physical change or deformation of a material by the action of heat such as the so-called wax-type heat-sensitive recording paper have been known for a long time. Such materials are utilized for electrocardiographs. The utilization of the physical changes is described in U.S. Pat. No. 3,131,080.

In addition, various heat-sensitive recording sheets utilizing the chemical changes of materials induced by the action of heat have been proposed. In particular, the so-called two-component coloring type heat-sensitive recording paper is well known as described in U.S. Pat. Nos. 2,663,654, 2,663,655 and 2,967,785.

Heat-sensitive recording papers involve first order coloring, i.e., they do not require development. Therefore, the recording apparatus can be simplified. Furthermore, the cost of the recording paper and the recording apparatus are low, and the system is a nonimpact system giving no noise. In view of these advantages, such heat-sensitive recording systems have established a position as a low-speed recording systems. However, such heat-sensitive recording has a slow response speed as compared with other recording systems such as electrostatic recording systems.

The responding speed of a recording element is slow because the recording energy is heat. That is, heat conduction between a thermal head and a heat-sensitive recording paper which is brought into contact with the thermal head is insufficient. Accordingly, sufficient recording density is not obtained. A thermal head is composed of an assembly of dot-like electric resistant heating elements which generate heat in response to recording signals in order to melt and color the heat-sensitive color forming layer in contact with the thermal head. In order to obtain a clear high density recording with such a heat-sensitive recording system, the dot reproducibility must be good. More specifically, the energy generated from the thermal head must be effectively transferred to the heat-sensitive color forming layer during high-speed recording to create a coloring reaction therein and form dots corresponding to the dot heating elements of the thermal head. However, at present, only a small percentage of the heat generated from the thermal head is transferred to the heat-sensitive color forming layer. Accordingly, the efficiency of heat conductivity is extremely low.

Various efforts have been made to overcome this problem by altering both the recording apparatus and the recording paper. For example, various methods have been proposed for improving the smoothness of the heat-sensitive color forming layer so that the heat-sensitive color forming layer gets maximum possible contact with the thermal head.

Japanese Patent Publication No. 20142/77 describes a paper wherein the surface of the heat-sensitive color forming layer is surface-treated to 200 to 1,000 seconds by a Bekk smoothness. Japanese Patent Application (OPI) No. 115255/79 (the term "OPI" is used herein refers to a "published unexamined Japanese patent application") describes a paper having a Bekk smoothness of 200 to 1,000 seconds, wherein the heat-sensitive color forming layer can respond only to a thermal pulse of about 5 to 6 milliseconds. Accordingly, for high-speed recording below 1 millisecond, it is necessary to perform the smoothening treatment above 1,100 seconds by Bekk smoothness. If the Bekk smoothness is made higher than 1,100 seconds by pressing the heat-sensitive recording paper, color fog is formed by pressure. However, after the heat-sensitve recording layer is coated on the base paper increasing the smoothness to the Bekk smoothness above 500 seconds, if the Bekk smoothness is increased above 1,100 seconds by adjusting the surface of the heat-sensitive recording paper, the resulting recording paper can give high recording density without increasing fog formation. Japanese Patent Application (OPI) No. 156086/80 (British Pat. No. 2,051,391) describes a paper wherein surface roughness Ra and the gloss of the surface of a heat-sensitive color forming layer are controlled below 1.2 μm and 25%, respectively.

The smoothness of a heat-sensitive color forming layer is improved by only calender treatment such as with a super calender, machine calender or gloss calender. The calender treatment may be applied to only the base paper, the base paper and the heat-sensitive recording paper, or only to heat-sensitive recording paper.

Calender treatment may improve the smoothness, thereby improve recording density. However, such treatment is accompanied by various faults. One fault is the formation of fog, that is, coloring of the recording paper by the occurrence of a coloring reaction during the surface treatment step. To eliminate the fog, the addition of granular wax has been proposed in Japanese Patent Publication No. 14531/75. However, waxes generally have a large heat capacity and heat of melting. The properties reduce the heat response speed of the heat-sensitive recording sheet.

Calendering treatment of the paper creates increased contact with the recording element. Accordingly, the recording layer may adhere to the element at the coloring portion causing peeling and noise, and causing the accumulation of fused matter of the heat-sensitive recording layer on the surface of the element. This may cause a reduction of recording density and a reduction in dot reproducibility and running property of recording paper reduces (so-called sticking).

Calendering also decreases the writability of the paper with respect to a pencil or ball-point pen.

Notwithstanding these faults, calendering treatment is used because the improvement in smoothness results in a substantial improvement of the paper response speed.

SUMMARY OF THE INVENTION

A primary object of this invention is to provide a heat-sensitive recording paper having a high heat conductive effect between the recording element and the heat-sensitive recording paper which is not accompanied by the foregoing faults.

As a result of various investigations, the present inventors has succeeded in obtaining a heat-sensitive recording paper having excellent dot reproducibility, running property, and writability by limiting the optical contact ratio of the surface of the recording layer and the density of the recording sheet to specific domains.

The present invention is a heat-sensitive recording paper comprising a support base and a heat-sensitive recording layer formed thereon, the optical contact ratio of the surface of said heat-sensitive layer being 7% or more and the density of the recording paper being 0.9 g/cm$^3$ or less.

DETAILED DESCRIPTION OF THE INVENTION

The term "optical contact ratio" as used in this specification is the value obtained by placing under pressure a prism on a paper and optically measuring the contact ratio and the value is considered in principle a suitable value as the value relates to the contact extent of a thermal head and a heat-sensitive recording sheet.

The measuring principle is described in Sinpei Inamoto, *Measuring Method of Printing Smoothness of Paper Mainly by Optical Contact Method,* Ministry of Finance, Printing Bureau, Research Institute, Report, Vol. 29, No. 9, pages 615–622 (Sept., 1977). The measuring apparatus may be a dynamic printing smoothness measuring apparatus, made by Toyo Seiki Seisakusho K.K. The optical contact ratio in this invention is the value measured at a condition of a measuring wavelength of 0.5 μm after 10 milliseconds after pressing a prism onto a paper at a pressure of 15 kg/cm$^2$.

When the optical contact ratio of the surface of a recording measured by the condition is less than 7%, sufficient dot reproducibility cannot be obtained when contacting the heat-sensitive recording paper with a recording element. Therefore, the optical contact ratio of the surface of the recording layer in this invention is 7% or more, preferably 10 to 30%.

Better results with respect to dot reproducibility can be obtained if the optical contact ratio of the surface of the recording layer is larger. However, the present inventors have found that the running property, writability and dot reproducibility are reduced with the increase of the optical contact ratio. As a result of further investigations relating to dot reproducibility, running property, and writability, the present inventors have found that the density of the recording paper having the specific optical contact ratio as described above is a very important factor for obtaining good quality balance. More specifically, the present inventors have confirmed that if the density of the recording paper is larger than 0.9 g/cm$^3$, the running property and writability are poor and the dot reproducibility is reduced. Therefore, if the paper density is above 0.9 g/cm$^3$, a recording sheet having good quality balance cannot be obtained even when the optical contact ratio is higher than 7%. Accordingly, the recording paper of this invention has the specific optical contact ratio as described above as well as an adjusted density of 0.9 g/cm$^3$ or less, preferably 0.85 g/cm$^3$ or less, more preferably 0.80 to 0.70 g/cm$^3$.

In accordance with this invention, and throughout this disclosure density values are calculated from the basis weight and the measured value of thickness by JIS P-8118 (Japanese Industrial Standard).

There is no particular restriction as regards the production process of the heat-sensitive recording sheet having such a specific optical cotact ratio and density. These factors are properly controlled by the selections of the support for the recording sheet, the materials which make up the recording layer, the coating method for the recording layer, and the post treatment for the surface of the recording layer.

The support is preferably comprised of a base paper having a density of 0.9 g/cm$^3$ or less and the heat-sensitive recording layer wherein the surface of the recording layer coated has an optical contact ratio of 15% or more.

Such a base paper is obtained by drying a wet web after pressing or by drying a paper impregnated with water by pressing the paper onto the smooth surface of a metal. In accordance with such methods, a base paper having a large optical contact ratio can be obtained without increasing the density as with a calender treatment. In accordance with the most preferred production method, a wet web having a water content of 50 to 70% after being press prepared using a paper manufacturing machine having a Yankee dryer is dried to a water content of 15% or less by pressing the paper onto the Yankee dryer. Even when a base paper having an optical contact ratio of 15% or less is prepared by a paper machine having a multi-cylinder dryer, the base paper is coated or impregnated with water to increase the water content above 20% and the paper may be dried to a water content of 15% or less by pressing the wetted paper onto a Yankee dryer.

In order to further increase the optical contact ratio of the base paper, a liquid composed of a pigment and a polymer binder may be coated on or sprayed onto the paper before pressing the paper onto a Yankee dryer. Even if the optical contact ratio of a base paper is large, the optical contact ratio is reduced greatly by coating and hence the use of a base paper having a large optical contact ratio is meaningless. However, with a base paper dried by pressing onto a Yankee dryer, the reduction in optical contact ratio by coating is less. Therefore, heat-sensitive recording paper having a large optical contact ratio is obtained without increasing the density by using the base paper.

One criterion for reducing the optical contact ratio by coating an aqueous coating composition is the water expansion of the base paper when immersed in water. Base paper dried by a Yankee dryer showed a very low water expansion of cross direction of 2.5% or less and the reduction in optical contact ratio of the base paper by drying shrinkage after coating is less. Therefore, a heat-sensitive recording paper having a heat-sensitive color forming layer with a large optical contact ratio is obtained without requiring a strong calender treatment. On the other hand, an ordinary base paper dried by a multi-cylinder dryer shows a large water expansion of cross direction of 3 to 6%, shows a large reduction in optical contact ratio by coating, and requires a strong calender treatment, thereby increasing the density and sticking. Furthermore, a heat-sensitive recording paper prepared by using a base paper showing small water expansion shows less shrinkage of the surface of the base paper which is in contact with the heat-sensitive color forming layer by heating at recording and shows good contact with a thermal head during recording. The water expansion is a value measured by the method of J-TAPPI No. 27m. Base paper dried by pressing onto a Yankee dryer is effective in this invention because of having very high optical contact ratio and large void content. For example, the void content of a base paper of this invention having an optical contact ratio of 26.1% is 50% but the void content of a base paper having an optical contact ratio of 21.8% dried by a multi-cylinder dryer and super-calendered is 37%.

The void content of a paper is calculated by the following equation.

$$\text{Void content} = 1-(A/B)$$

A: Apparent density of a paper

B: True density of the paper

The apparent density is calculated from the basis weight and the measured value of thikness by JIS P-8118. True density is assumed to be 1.5. A large void content of a base paper shows that the base paper which is in contact with a heat-sensitive color forming layer absorbs a substantial amount of the fused matter of the heat-sensitive color forming layer with heating, thereby sticking is reluctant to occur. In order to obtain a high recording density with a heat-sensitive recording sheet using usual base paper dried by a multicylinder dryer, it is necessary to first subject the base paper to a calender treatment. The calendering treatment is not preferred because of making the density of the base paper to higher than 0.9 g/cm$^3$. However, by using a base paper having a density of 0.9 g/cm$^3$ or less and a high optical contact ratio, a heat-sensitive recording paper having higher recording density can be obtained.

By using a base paper having a void content above 40%, a density of 0.9 g/cm$^3$ or less, and an optical contact ratio of 15% or more, the heat-sensitive recording paper will produce a high density image and not cause sticking and piling. The air permeability and oil absorption of the base paper also affect the fused material absorptive faculty of the base paper, that is, the sticking preventing faculty. In such a base paper, the optical contact ratio is 15% or more, the air permeability is low, and the value of the air permeability (sec.) divided by the basis weight (g/m$^2$) is 2 or less. The value of the air permeability of a base paper having an optical contact ratio of 21.8% and a density of 0.95/cm$^3$ dried by a multi-cylinder dryer and super-calendered divided by the basis weight thereof is 2.5.

Also, it is preferred that the oil absorption of 300 sec. or less.

The air permeability is a value measured by JIS P-8117 (Japanese Industrial Standard) and the oil absorption is a value measured by JIS P-8130 (1963) (Japanese Industrial Standard).

Enhancing beating of pulp is an example of one method for improving the smoothness of a base paper and improving the smoothness of a heat-sensitive recording paper. For example, Japanese Patent Application (OPI) No. 24191/81 describes that a paper having a density above 0.9 g/cm$^3$ using a pulp having a Canadian standard freeness below 250 cc is used as the base paper. However, the enhancing of beating increases the density of the base paper and reduces the void content, which are undesirable for the invention in view of preventing sticking and piling. The base paper provided with a smoothness dried by pressing onto a Yankee dryer has a Canadian standard freeness above 250 cc but a preferred Canadian standard freeness for obtaining a sufficient smoothness is 300 to 400 cc. When increasing the void content, a base paper having an optical contact ratio above 15% is obtained even if the Canadian standard freeness is 400 cc to the state of unbeaten. If the optical contact ratio of a base paper is 15% or more, a heat-sensitive recording paper shows a higher recording density and excellent running property for recording a compared to the case of using a conventional base paper dried by a multi-cylinder dryer. When a high recording density at high-speed recording is required, it is preferred to use a base paper having an optical contact ratio of at least 20%. More preferably, a base paper having an optical contact ratio of at least 25% is used. Such a base paper is prepared using a wood pulp such as NBKP, LBKP, NBSP, LBSP, etc. Also, it is possible to increase the void content of a base paper by using a mixture of the foregoing wood pulp and a synthetic pulp.

When producing the base paper, a filler such as clay, talc, calcium carbonate or urea resin particles; a sizing agent such as rosin, alkenylsuccinic acid, alkylketene dimer or a petroleum resin; and a fixing agent such as aluminum sulfate or a cationic polymer, may be added to the pulp. Also, a pigment such as calcium carbonate or synthetic aluminum silicate; a polymer adhesive such as starch, polyvinyl alcohol or a SBR latex may be coated on the base paper by a size press in a range not exceeding 2 in the value of the air permeability divided by the basis weight and 300 sec. in the oil absorption.

Furthermore, the back surface of a base paper may be coated with a coating cmposition for curling prevention or preventing the heat-sensitive color forming layer from being changed with the passage of time.

A base paper containing no sizing agent and having a Stoökigt sizing degree of 0 secong can be used as the base paper in this invention. However, it is preferred to impart a sizing degree (of Cobb Test) of 15 to 25 g/m$^2$ by incorporating a sizing agent into the paper. A base paper dried by pressing onto a Yankee dryer may be further treated by a super calender, a machine calender, or a gloss calender to improve the optical contact ratio. Thus, a high optical contact ratio is obtained as compared with a base paper dried by a multi-cylinder dryer even at a low density.

A method of producing the heat-sensitive recording paper of this invention will now be explained. In general, a color former and a color developer are separately dispersed in aqueous solutions of a water-soluble polymer using dispersers such as separate ball mills. When using, for example, a ball mill to obtain fine particles of color former and color developer, balls having different sizes are used in proper mixing ratios and each component is dispersed for a sufficient period of time. Also, a horizontal-type sand mill (e.g., Dainomill, trade name) can be used effectively to mix the dispersions.

The dispersion of color former obtained is mixed with the dispersion of color developer obtained and then an inorganic pigment, a wax, a higher fatty acid amide, a metal soap, and, if necessary, an ultraviolet absorbent, an antioxidant, and a latex series binder, are added to the mixture to form a coating solution. The additives may be added to the dispersions during the preparation of the individual dispersions.

The coating solution is generally coated on the support so that the amount of the color former is 0.2 g/m$^2$ to 1.0 g/m$^2$.

In general, any color formers used for ordinary pressure-sensitive recording papers, of heat-sensitive recording papers can be used without restriction. Practical examples of useful color formers include:

(1) triarylmethane compounds such as 3,3-bis-(p-dimethylaminophenyl)-6-dimethylaminophthalide (i.e., Crystal Violet lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis(9-ethylcarbazol-3-yl)-5-dimethylaminophthalide and 3,3-bis(2-phenylindol-3-yl)-5-dimethylaminophthalide;

(2) diphenylmethane compounds such as 4,4-bis-dimethylaminobenzhydrin benzyl ether, N-halophenyl leucoauramine and N-2,4,5-trichlorophenyl leucoauramine;

(3) xanthene compounds such as rhodamine B-anilinolactam, 3-diethylamino-7-dibenzylaminofluoran, 3-diethylamino-7-butylaminofluoran, 3-diethylamino-7-(2-chloroanilino)fluoran, 3-diethylamino-6-methyl-7-anilinofluoran, 3-piperidino-6-methyl-7-anilinofluoran, 3-ethyltolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofuoran, 3-diethylamino-6chloro-7-anilinofluoran, 3-N-cyclohexyl-N-methylamino-6-methyl-7-anilinofluoran and 3-diethylamino-7-phenylfluoran;

(4) thiazine compounds such as benzyl leucomethylene blue and p-nitrobenzyl leucomethylene blue; and (5) spiro compounds such as 3-methyl-spirodinaphthopiran, 3-ethyl-spiro-dinaphthopiran, 3-benzylspiro-dinaphthopiran and 3-methylnaphtho(3-methoxybenzo)spiropyran.

They may be used solely or as a mixture of them. They are suitably selected according to the use or the characteristics of the heat-sensitive recording materials.

Phenol derivatives and aromatic carboxylic acid derivatives are preferably used as the color developers and bisphenols are particularly preferred.

Practical examples of the phenols include p-octylphenol, p-tert-butylphenol, p-phenylphenol, 2,2-bis(p-hydroxy)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethyl-hexane and 2,2-bis(4-hydroxy-3,5-dichlorophenyl)propane.

Practical examples of the aromatic carboxylic acid derivatives include p-hydroxybenzoic acid, propyl p-hydroxybenzoate, butyl p-hydroxybenzoate, benzyl p-hydroxybenzoate, 3,5-di-α-methylbenzylsalicyclic acid and carboxylic acid, or the polyvalent metal salts of these acids.

It is preferred that these color developers are added in the form of an eutectic mixture with a low melting point thermofusible material for fusing at a desired temperature to cause a color forming reaction or fine particles to the surface of which a low melting point material is fused.

Examples of the low melting point materials used in this invention include paraffin wax, carnauba wax, microcrystalline wax, polyethylene wax and higher fatty acid amides such as stearic acid amide, ethylenebis-stearoamide and higher fatty acid esters.

Examples of metal soaps used in this invention include polyvalent metal salts of higher fatty acids, such as zinc stearate, aluminum stearate, calcium stearate and zinc oleate.

Examples of inorganic pigments include kaolin, calcined kaoline, talc, agalmatolite, diatomaceous earth, calcium carbonate, aluminum hydroxide, magnesium hydroxide, magnesium carbonate, titanium oxide and barium carbonate.

The inorganic pigment preferably has an amount of an oil absorption of 60 ml/100 g or more and a mean particle size of 5 μm or less. It is desirable that the oil absorptive inorganic pigment is incorporated in the recording layer at a dry weight of 5 to 50% by weight, preferably 10 to 40% by weight.

The low melting point materials, metal soaps and inorganic pigments are dispersed in a binder and coated on a support. A water-soluble binder is generally used. Practical examples include polyvinyl alcohol, hydroxyethyle cellulose, hydroxypropyl cellulose, ethylene-maleic anhydride copolymer, styrene-maleic anhydride copolymer, isobutylene-maleic anhydride copolymer, polyacrylic acid, starch derivatives, casein and gelatin.

In order to make these binders waterproof, a water resisting agent (gelling agent, cross-linking agent) may be added or an emulsion of a hydrophobic polymer such as a styrene-butadiene rubber latex or an acrylic acid resin emulsion may be added to the binder.

The binder is incorporated in the recording layer at a dry weight of 10 to 30% by weight. Furthermore, if necessary, a defoaming agent, a fluorescent dye or a colored dye may be added to the coating composition.

In order to form the recording layer, the coating composition can be coated by a known coating method such as a blade coating method, an air-knife coating method, a gravure coating method, a roll coating method, a spray coating method, a dip coating method, a bar coating method or an extrusion coating method.

There are no particular restrictions relating to the coating amount of the coating composition on the support for forming the recording layer. However, the composition is usually coated in an amount in the range of 3 to 15 g/m$^2$, preferably 4 to 10 g/m$^2$ by dry weight.

Also, the recording layer thus formed is surface-treated, if necessary, by calender, super calender, etc., but is treated so that the optical surface contact ratio of the surface of the recording layer and the density of the recording paper are within the specific values defined herein.

The present inventors have found that when surface treatment is performed by passing the recording paper through a pressing means composed of a metal roll and an elastic roll having a Shore hardness of 70 to 90 so that the recording layer surface is brought into contact with the metal roll, the recording density is increased without causing a formation of fog.

However, even by using a super calender or a machine calender, the heat-sensitive recording paper having the specific optical contact ratio and density as defined herein can be obtained as a matter of course by controlling the nip pressure.

The invention will now be practically explained by the following examples but the invention is not limited to these examples. In the examples, all parts and percentages are by weight unless otherwise indicated.

EXAMPLE 1

A mixture of 20 g of 3-diethylamino-6-chloro-7-(β-ethoxyethylamino)fluoran and 100 g of an aqueous solution of 5% polyvinyl alcohol (polymerization degree:

1,000 and saponification degree: 90%) was dispersed for about 24 hours in a ball mill to provide Solution A.

A mixture of 60 g of bisphenol A, 60 g of stearic acid amide, and 900 g of an aqueous solution of 5% polyvinyl alcohol (having the properties described above) was dispersed for about 24 hours in a ball mill to provide Solution B.

Solution A and Solution B were mixed with each other and after adding thereto 1,200 g of calcium carbonate (Unibar, trade name, made by Shiraishi Kogyo K.K) and 6,000 g of an aqueous solution of 5% polyvinyl alcohol, the resultant mixture was dispersed well to provide a coating composition.

After beating 100 parts of LBKP to a Canadian standard freeness of 350 cc, 1 part of rosin and 2 parts of aluminum sulfate were added to the pulp and a base paper of a basis weight of about 50 g/m$^2$ was made from the pulp by means of a Fourdriner paper machine. The wire surface of the wet web which passed through a pressing portion was pressed onto a Yankee dryer having a surface temperature of 120° C. to obtain a water content of 8%. The paper was then treated by a machine calender.

The coating composition for the heat-sensitive recording layer was coated on the base paper thus obtained by an air knife coating method at a coating weight of 7 g/m$^2$ solid content. After drying the coated paper to a water content of 6%, the coated paper was surface-treated by passing it through a pressing means composed of a combination of a hard chrome-plated roll and a hard rubber roll (Shore hardness of 80) to provide a heat-sensitive recording paper having an optical contact ratio of 12% and a density of 0.78.

EXAMPLE 2

The heat-sensitive recording paper obtained in Example 1 was applied to a super calender to provide a heat-sensitive recording paper having an optical contact ratio of 15% and a density of 0.85.

COMPARATIVE EXAMPLE 1

After beating 100 parts of LBKP to a Canadian standard freeness of 350 cc, 1 part of rosin and 2 parts of aluminum sulfate were added to the pulp and a base paper having a basis weight of about 50 g/m$^2$ was made by a Fourdriner paper machine. The wet web which passed through the pressing portion was dried by a multi-cylinder dryer having a surface temperature of 100° to 130° C. to a water content of 8% and applied to a machine calender.

The heat-sensitive recording coating composition obtained in Example 1 was coated on the base paper thus obtained by an air knife coating method at a coating weight of 7 g/m$^2$ solid content. After drying the coated paper to a water content of 6%, the coated paper was applied to a super calender to provide a heat-sensitive recording paper having an optical contact ratio of 10% and a density of 0.92.

COMPARATIVE EXAMPLE 2

The heat-sensitive recording paper prepared in Comparative Example 1 was applied to a machine calender to provide a heat-sensitive recording paper having an optical contact ratio of 6% and a density of 0.87.

Each of the heat-sensitive recording sheets thus obtained was overall colored by applying an energy of 2 ms/dot and 40 mj/mm$^2$ and a density of 5 dots/mm in main scanning and 6 dots/mm in side scanning with a recording element. The recording density and the fog density were measured by means of a Macbeth RD-514 type Reflection Densitometer using a Wratten No. 106 filter.

At the same time, recording was continued and the formation state of sticking was observed.

Furthermore, using a ball point pen and a pencil, the writability on the heat-sensitive recording sheets was evaluated.

The optical contact ratio was measured in accordance with the procedure described herein at beginning and the oil absorption was measured by placing a drop of polybutene oil on the paper, spreading the drop by rolling a roller and then measuring the time when the gloss of the oil spot decreases to the constant low level.

The properties of the base paper are shown in Table 1 and the properties of the heat-sensitive recording sheet are shown in Table 2. The heat-sensitive recording sheet in Example 1 is excellent in recording density, dot reproducibility, sticking, and writability as compared to those in Comparative Examples 1 and 2.

TABLE I (Properties of Base Paper)

| | Basis Weight (g/m$^2$) | Thickness (μm) | Density (g/cm$^3$) | Optical Contact Ratio (%) | Oil Absorption (sec) |
|---|---|---|---|---|---|
| Example 1 | 51.8 | 70 | 0.74 | 26.1 | 10 |
| Comparative Example 1 | 50.6 | 62 | 0.82 | 4.5 | 24 |

TABLE 2

(Properties of Heat-Sensitive Recording Paper)

| | Recording Density | Dot Reproducibility | Fog Density | Sticking | Writability | Optical Contact Ratio (%) | Basis Weight (g/m$^2$) | Thickness (μ) | Density (g/cm$^3$) |
|---|---|---|---|---|---|---|---|---|---|
| Example 1 | 1.15 | Excellent | 0.08 | None | Excellent | 12 | 60 | 77 | 0.78 |
| Example 2 | 1.25 | " | 0.10 | " | " | 15 | 60 | 71 | 0.85 |
| Comparative Example 1 | 0.84 | Good | 0.15 | Observed | No good | 10 | 58.6 | 64 | 0.92 |
| Comparative Example 2 | 0.73 | No good | 0.12 | " | Good | 6 | 58.6 | 67 | 0.87 |

Note:

(1) In dot reproducibility, "Excellent" shows that the colored image around the dot is sharp and the dot size is uniform, "Good" shows that the dot size is slightly unevenness, and "No good" shows that the dot not recorded is present.

(2) In sticking, "None" shows that adhesion of foreign body is not observed on the surface of the recording element and "Observed" shows that adhesion of foreign body is slightly observed.

(3) In writability, "Excellent" shows that the colored literal image is without becoming thin, sharp and can be read, "Good" shows that the literal image is slightly not sharp but can be read, and "No good" shows that the literal image is not sharp and cannot be read at all.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

a support base comprised of paper having a density of 0.9 g/cm$^3$ or less; and a heat-sensitive recording layer coated on a surface of the support base, the surface of the coated layer having an optical contact ratio 7% or more.

2. A heat-sensitive recording paper as claimed in claim 1, wherein the optical contact ratio of the surface of the coated layer is in the range of 10% to 30%.

3. A heat-sensitive recording paper as claimed in any of claims 1 or 2, wherein the support base is comprised of a paper having a density of 0.85 g/cm$^3$ or less.

4. A heat-sensitive recording paper as claimed in claim 3, wherein the support base is comprised of paper having a density within the range of 0.80 to 0.70 g/cm$^3$.

5. A heat-sensitive recording paper as claimed in claim 1, wherein the support base is produced by drying a wet web having a water content of 50 to 70% to a water content of 15% or less by pressing the paper onto the Yankee dryer.

6. A heat-sensitive recording paper as claimed in claim 1, wherein the support base has a void content above 40%.

7. A heat-sensitive recording paper as claimed in claim 1, wherein the support base is incorporated with a sizing agent and has a sizing degree of 15 to 25 g/m$^2$.

8. A heat-sensitive recording paper as claimed in claim 1, wherein the heat-sensitive recording layer includes a color developer and a color former and wherein the color former is present in an amount of 0.2 g/m$^2$ to 1.0 g/m$^2$.

* * * * *